US008415270B2

(12) United States Patent
Yada et al.

(10) Patent No.: US 8,415,270 B2
(45) Date of Patent: Apr. 9, 2013

(54) HEAT SENSITIVE RECORDING MATERIAL COMPRISING A PROTECTIVE LAYER

(75) Inventors: Hidenori Yada, Tokyo (JP); Shigetoshi Seki, Amherst, MA (US)

(73) Assignee: Kanzaki Specialty Papers, Ware, MA (US)

( * ) Notice: Subject to any disclaimer, the term of this patent is extended or adjusted under 35 U.S.C. 154(b) by 431 days.

(21) Appl. No.: 12/694,802

(22) Filed: Jan. 27, 2010

(65) Prior Publication Data

US 2010/0190644 A1 Jul. 29, 2010

Related U.S. Application Data

(60) Provisional application No. 61/147,643, filed on Jan. 27, 2009.

(51) Int. Cl.
*B41M 5/42* (2006.01)

(52) U.S. Cl.
USPC ..... 503/207; 503/226

(58) Field of Classification Search ..... None
See application file for complete search history.

(56) References Cited

U.S. PATENT DOCUMENTS

| | | | | |
|---|---|---|---|---|
| 6,759,366 | B2 | 7/2004 | Beckerdite et al. | |
| 7,494,954 | B2 * | 2/2009 | Mito et al. | 503/200 |
| 7,635,661 | B2 * | 12/2009 | Iida et al. | 503/207 |
| 7,709,416 | B2 * | 5/2010 | Iida et al. | 503/207 |

* cited by examiner

*Primary Examiner* — Bruce H Hess
(74) *Attorney, Agent, or Firm* — O'Shea Getz P.C.

(57) ABSTRACT

A heat-sensitive recording material comprises a support, a heat-sensitive recording layer including a leuco dye and a developer, and a protective layer comprising a pigment and a binder. The heat-sensitive recording layer is located between the support and the protective layer. The pigment in the protective layer comprises secondary particles with an average particle diameter of about 30 to 900 nm formed preferably by aggregation of amorphous silica primary particles with a particle diameter of about 3 to 70 nm. The secondary particles are present in a proportion of about 5 to 35 mass % relative to total solids of the protective layer. The colloidal silica is present in a proportion of about 1 to 25 mass % relative to total solids of the protective layer.

24 Claims, 3 Drawing Sheets

| | Content[%] | | Results | | | | |
|---|---|---|---|---|---|---|---|
| | Silica | Colloidal Silica | Haze | Sticking | Blistering | Ink Adhesion | Barrier |
| Comparative Example I-1 | 15-30 | 5-20 | A | A | A | A | A |
| Comparative Example I-2 | 15-30 | 0 | A | B | C | A | A |
| Comparative Example I-3 | 15-30 | 30 | B | A | A | A | A |
| Comparative Example I-4 | 0 | 5-20 | A | A | A | C | A |
| Comparative Example I-5 | 40 | 5-20 | C | B | A | A | B |
| Comparative Example I-6 | 15-30*1 | 5-20 | C | B | A | B | B |

*1 Secondary Particle Size of Silica is 900nm or More

FIG. 4

| | Content[%] | | | Results | | | |
|---|---|---|---|---|---|---|---|
| | Urethane Ionomer | Zinc Stearate | Core Cell Emulsion | Haze | Sticking | Ink Adhesion | Surface Strength |
| Example I-1 | 5-12 | 25 | 10-25 | C | A | A | A |
| Example I-2 | 20 | 7-20 | 10-25 | A | B | A | A |
| Example I-3 | 0 | 7-20 | 10-25 | A | A | C | A |
| Example I-4 | 5-12 | 0 | 10-25 | A | C | A | A |
| Example I-5 | 5-12 | 7-20 | 0 | A | A | A | C |

FIG. 5

HEAT SENSITIVE RECORDING MATERIAL COMPRISING A PROTECTIVE LAYER

CROSS REFERENCE TO RELATED APPLICATIONS

This application claims priority from the provisional application designated Ser. No. 61/147,643 filed Jan. 27, 2009 and entitled "Heat Sensitive Recording Material Comprising a Protective Layer". This application is hereby incorporated by reference.

TECHNICAL FIELD

The present invention relates to a heat-sensitive recording material comprising a heat-sensitive recording layer and a protective layer that utilizes the color forming reaction between a leuco dye and a developer.

BACKGROUND

Heat-sensitive recording materials are well-known, and utilize the color forming reaction between a leuco dye and a developer to produce recorded images by heat. Such heat-sensitive recording materials are relatively inexpensive, and the recording apparatuses are compact and easily maintained. For these reasons, heat-sensitive recording materials have found a wide range of uses, for example, they are used not only as recording media for the output of facsimiles and a variety of computers, printers of scientific measuring equipment, et cetera, but are also used as recording media for a variety of printers of POS labels, ATMs, CAD, handy terminals, paper for various tickets, et cetera.

However, when such heat-sensitive recording materials come into contact with oil, and plasticizers such as films or the like, alcohol, water, etc., problems occur such as fading of the color of recorded images, background coloration, adhesion of residue to the thermal-recording head during recording and the like.

In order to avoid such problems, a protective layer composed of, e.g., a water-soluble resin such as polyvinyl alcohol, starch, acrylic resin or the like and a pigment such as kaolin, calcium carbonate, amorphous silica, colloidal silica or the like (see for example, Japanese Unexamined Patent Publication Nos. 1993-147354; 1995-9762; 2000-118138; 2000-238432; 2002-240430; 2004-223994; and 2003-191647), was placed on the heat-sensitive recording layer. Pigments such as calcium carbonate, amorphous silica and colloidal silica have been used for preventing the adhesion of residue to the thermal head. For example, a heat-sensitive recording material comprising a protective layer principally composed of a resin and a filler with a Mohs hardness of 2.0 or less has been proposed which does not cause thermal-head wear and has less adhesion of residue to the thermal head (see for example Japanese Unexamined Patent Publication No. 1993-147354).

In recent years, heat-sensitive recording materials have frequently been used as printed ticket forms and similar forms and documents. Printing with ultraviolet curable ink, in particular, has been widely used, since it offers advantages such as: (1) solvent-free, therefore safety guaranteed; (2) fast drying speed due to ultraviolet drying; (3) energy savings achieved by compact UV irradiators; and (4) lowered drying temperature that leads to less background fogging by heat, especially in heat-sensitive recording materials.

However, protective layers with satisfactory properties have yet to be attained, because conventional protective layers present problems such as (a) low adhesion of ink to heat-sensitive recording materials causes printed surfaces to be easily removed by, for example, cellophane tape; (b) during recording with a thermal head, ink fuses by heat and adheres to the thermal head, easily causing a sticking phenomenon; and (c) the thickness of an ink layer printed on the surface of the protective layer of a heat-sensitive recording layer attenuates the recording energy from the thermal head, resulting in lowered recording sensitivity.

Therefore, there is a need to improve the surface strength of the press print ink and water resistance to heat sensitive recording material.

SUMMARY OF THE INVENTION

According to an aspect of the present invention, a heat-sensitive recording material comprises a support, a heat-sensitive recording layer that includes a leuco dye and a developer, and a protective layer comprising a pigment and a binder. The heat-sensitive recording layer is located between the support and the protective layer. The pigment in the protective layer comprises secondary particles with an average particle diameter of about 30 to 900 nm formed preferably by aggregation of amorphous silica primary particles with a particle diameter of about 3 to 70 nm. The secondary particles are present in a proportion of about 5 to 35 mass % relative to total solids of the protective layer. The colloidal silica is present in a proportion of about 1 to 25 mass % relative to total solids of the protective layer.

Non-crystalline silica, i.e., amorphous silica, or colloidal silica may be used as a pigment for use in the protective layer. The haze of the support layer is preferably less than 10%. An anti-slip layer may be located on the opposite of the support layer from the heat sensitive recording layer, such that the substrate is located between the anti-slip layer and the heat-sensitive layer. The binder of the protective layer may comprise urethane ionomer, present for example, in a proportion of about 1 to 25 mass % relative to total solids of the protective layer. The binder of the protective layer may also include a water-soluble resin. The water-soluble resin may be for example a polyvinyl alcohol or a modified polyvinyl alcohol, the polyvinyl alcohol or modified polyvinyl alcohol being present in a proportion of about 10 to 45 mass % based on total solids of the acrylic resin. The water-soluble resin may comprise acetoacetyl-modified polyvinyl alcohol with a polymerization degree of about 500 to 1800.

The protective layer may include zinc stearate in which particles with an average particle diameter of about 0.2 to 1.0 μm, a proportion of about 5 to 25 mass % relative to total solids of the protective layer.

For binder of the heat-sensitive recording material, core cell emulsion may be contained and the cell layer is copolymer of styrene-(meta) acrylic which was used as emulsifiers of monomer for forming copolymerized core layer. The core shell emulsion may be present in a proportion of about 5 to 25 mass % relative to total solids of the thermal layer.

The leuco dye may be 3-di(N-butyl)amino-6-methyl-7-anilinofluoran. An average particle diameter of the leuco dye and developer are about 0.3 to 0.8 μm each.

The thermal layer comprises pigment and some additives, the particle diameter which more than 90 mass % relative to total solids of the all slurry for thermal color composition is less than 0.8 μm.

Advantageously, the heat-sensitive recording material exhibits excellent ink adhesion and water resistance without adhesion of residue to a thermal head and reduced sticking.

These and other objects, features and advantages of the present invention will become more apparent in light of the following detailed description of preferred embodiments thereof, as illustrated in the accompanying drawings.

BRIEF DESCRIPTION OF THE DRAWING

FIG. 4 is a tabular summary of the test results for Comparative Examples I-1 to I-6; and FIG. 5 is a tabular summary of the test results for the Examples I-1 to I-5.

DETAILED DESCRIPTION OF THE INVENTION

Figure 1:
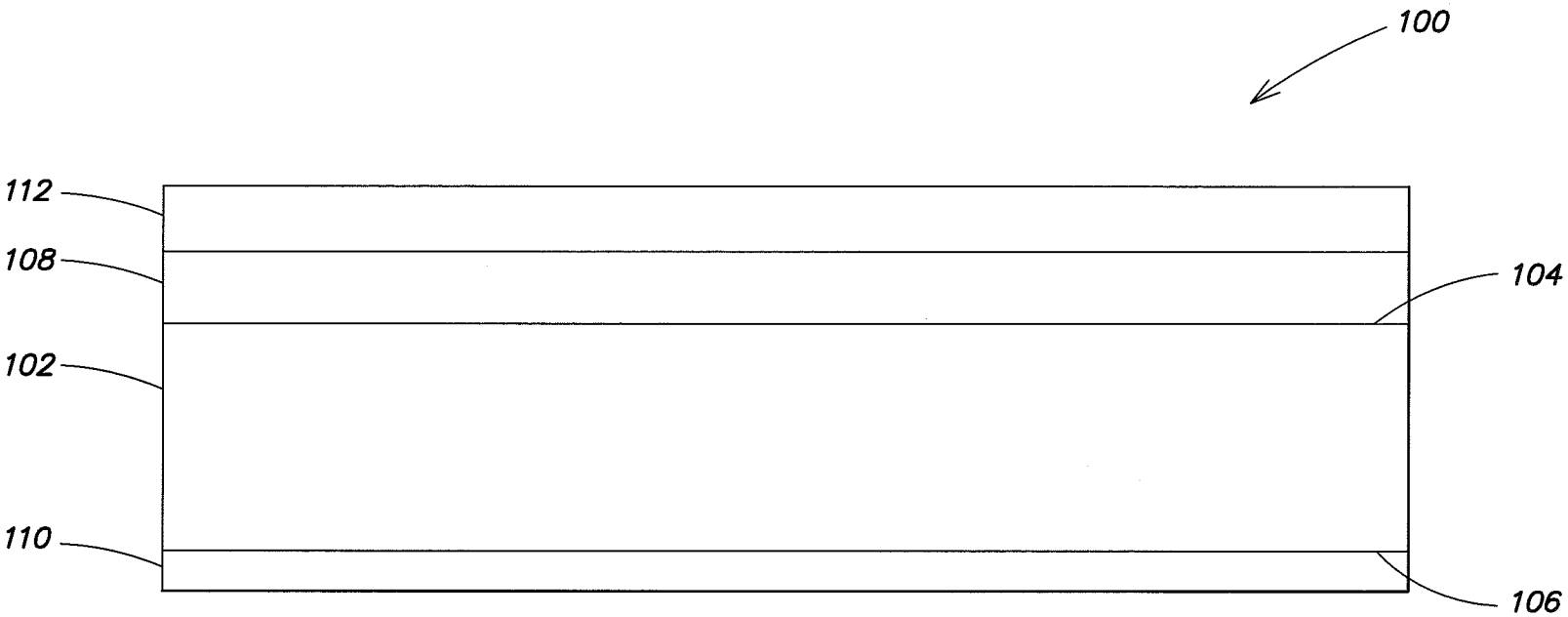
FIG. 1 is a cross sectional illustration of a sheet of thermal paper.

FIG. 1 is a cross sectional illustration of an heat-sensitive recording material (e.g., thermal paper) 100, that includes a substrate 102 having a first surface 104 and a second surface 106, a heat-sensitive layer 108 and a anti-slip layer 110. The heat-sensitive recording material also includes a protective layer 112, and the heat-sensitive layer 108 is located between the protective layer 112 and the substrate 102.

The heat-sensitive recording layer 108 may include a leuco dye and a developer, and the protective layer 112 may include a pigment and a binder. The pigment may comprise secondary particles with an average particle diameter of about 30 to 900 nm formed preferably by aggregation of amorphous silica primary particles with a particle diameter of about 3 to 70 nm The secondary particles may be present in a proportion of about 5 to 35 mass % relative to total solids of the protective layer. The colloidal silica may include a proportion of about 1 to 25 mass % relative to total solids of the protective layer.

Figure 2:
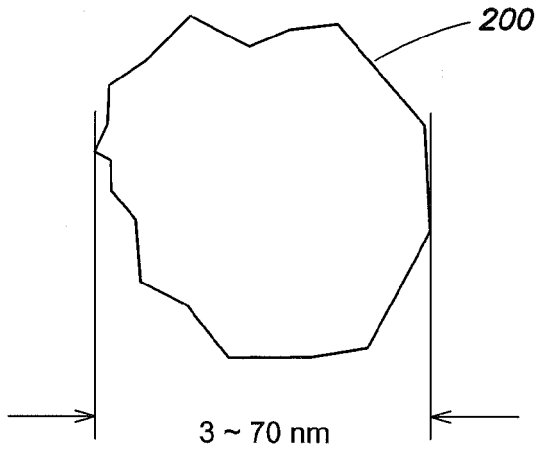
FIG. 2 is a pictorial illustration of an amorphous silica primary particle.

FIG. 2 is a pictorial illustration of an amorphous silica primary particle 200. The primary particle diameter Dp may be determined according to the following equations:

$$Asp(\mathrm{m}^2/\mathrm{g})=SA\times n \quad \text{(EQ. 1)}$$

where Asp represents the specific surface area, SA represents the surface area of a single primary particle, and n represents the number of primary particles per 1 g; and $$Dp(\mathrm{nm})=3000(\times 10^{-9}\ \mathrm{g/m})/Asp \quad \text{(EQ. 2)}$$

where Dp represents the primary particle diameter, and Asp represents the specific surface area.

EQ. 2 is derived based on the assumption that the silica primary particles have a spherical shape, and the density of the silica is $d=2(\mathrm{g/cm}^3)$.

The specific surface area Asp denotes the surface area of amorphous silica per unit mass (i.e., per 1 g). Referring to EQ. 2, the smaller the value of the primary particle diameter is, the greater the value of the specific surface area is. The smaller the primary particle diameter is, the smaller the pores formed from the primary particles (i.e., pores formed in the secondary particles that are composed of agglomerates of the primary particle) are, thus resulting in higher capillary pressure. The fused ink component is believed to be absorbed rapidly for this reason, resulting in reduced sticking. It is also assumed that the arrangement of secondary particles formed from the primary particles becomes complex, thus ensuring a volume that can sufficiently absorb the fused ink component. The particle diameter of the primary particles may be from about 3 to 70 nm, preferably from about 5 to 50 nm, and more preferably from about 7 to 40 nm. The lower the upper limit for the particle diameter of the primary particles, the less the adhesion of residue to the thermal head becomes, and the better the anti-sticking properties become.

The specific surface area of amorphous silica was herein determined by drying a fine pigment (i.e., the amorphous silica used in the invention) at 105° C., and then measuring the nitrogen absorption-desorption isotherm of the resulting powder sample with a specific surface area measuring apparatus ("SA3100", manufactured by Coulter) after vacuum degassing at 200° C. for 2 hours, so as to calculate the BET specific surface area.

Figure 3:
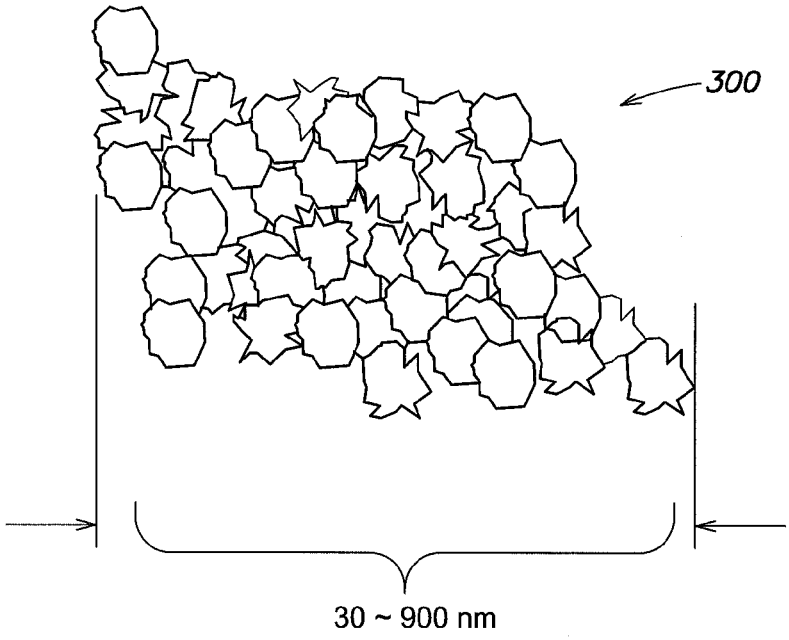
FIG. 3 is a pictorial illustration of secondary particles.

FIG. 3 is a pictorial illustration of secondary particles 300. The average particle diameter of the secondary particles is from about 30 to 900 nm, preferably from about 40 to 700 nm, and more preferably from about 50 to 500 nm. Secondary particles with an average particle diameter of less than about 30 nm are not only difficult to make, but also form pores whose volume is too small for the fused ink component to penetrate through, resulting in a risk of sticking. Conversely, secondary particles with an average particle diameter of more than about 900 nm may result in lowered transparency, lowered recording sensitivity and/or lowered barrier properties.

The average particle diameter of the secondary particles was herein determined as follows. The aqueous silica dispersion obtained by the method described above was adjusted to a solids content of 5 mass %. The dispersion was then stirred and dispersed using a homomixer at 5,000 rpm for 30 minutes, and was immediately applied over a hydrophilicated polyester film in an amount of about 3 $\mathrm{g/m}^2$ on a dry weight basis, and dried for use as a sample. The sample was observed with electron microscopes (SEM and TEM), and then electron micrographs of the sample were taken at a magnification of 10,000×. to 400,000×. The Martin's diameters of the secondary particles in a 5-cm square of the electron micrographs were determined, and the average of the Martin's diameters was calculated (see "Biryushi handbook (Handbook for Fine Particles)", Asakura Publishing, 1991, p. 52).

The above-defined secondary particles having an average particle diameter of 30-900 formed by aggregation of amorphous silica primary particles with a particle diameter of 3 to 70 nm may be produced by non-limiting suitable method. Examples of methods include mechanically pulverizing commercially available synthetic amorphous silica or a like massive raw material, or mechanically pulverizing a precipitate formed by chemical reaction in the liquid phase or the like; the sol-gel process via the hydrolysis of metal alkoxide; high-temperature hydrolysis in the gas phase; and the like. Examples of mechanical techniques include the use of ultrasonic mill, high-speed rotation mill, roller mill, ball mill, media-agitating mill, jet mill, sand grinder, wet-type Media-less Ultra-atomization technology devices and the like. In the case of mechanical pulverization, pulverization is preferably performed in water to make an aqueous silica dispersion.

The content of the secondary particles in the protective layer is preferably from about 5 to about 35 mass %, ink adhesion is poor if less than 5 mass % and it is difficult to obtain the high clarity to heat sensitive material. Within the range of 5 to 35 mass %, the desired effects such as excellent clarity and press printability, in particular, can be readily attained.

The content of the colloidal silica in the protective layer is preferably from about 1 to about 25 mass % and more preferably from about 5 to about 20 mass % of total solids of the protective layer. Within the range of 1 to 25 mass %, the aforementioned desired effects such as excellent clarity, in particular, can be attained along with reduced sticking, head residue and blistering on thermal printer head.

Within the range of about 1 to 25 mass %, high/easy releasing can be expected.

Colloidal silica may be substantially composed of primary particles, and is substantially free from secondary particles that are agglomerates of the primary particles.

The haze amount should be less than 10% haze of high clarity support layer, and preferably less than 7% haze amount, and more preferably less than 4% haze amount. The low haze amount of the support layer provides high clarity heat sensitive material.

The support layer may include the amorphous silica of general commercial products, mechanical ground silica by liquid phase deposition, vapor-phase cracking and alkoxide process.

The support layer may be selected from papers, coated papers whose surfaces are coated with pigments, latex and the like, multilayered synthetic papers made from polyolefin-based resins, plastic films, and composite sheets thereof.

The content of the polyurethane ionomer in the protective layer is preferably from about 2 to 15 mass % and more preferably from about 5 to 12 mass % of total solids of the protective layer. Within the range of about 2 to 15 mass %, the aforementioned desired effects such as excellent press printability, in particular, can be readily attained.

Polyurethane ionomer may comprise a water base urethane resin of colloidal dispersion. The polyurethane ionomer differs from dispersed normal emulsion type in the water with original emulsification. It is possible to disperse the polyurethane ionomer into the water and to small particle without emulsifier and organic solvent because of the polyurethane ionomer has own ion groups which are hydrophilic group.

Generally, polyurethane ionomer is one of polymer with reacted diol and isocyanates compound, ionic cross-linked with metal ions which ionize the carboxylic acid group that is adopted in the polymer.

As for polyhydroxy compound for the combination of the polyurethane ionomer, for example, poly-ethylene glycols, poly-propylene glycol, polyethylene•propylene glycol, poly-tetra-methylene glycols, 1,5-penthanediol, di-ethylene glycol, tri-ethylene glycol, polycprolactone, polyhexa methylene-adipate, polyhexa methylene-sebacate, poly-tetra-methylene-sebacate, tri-methylol-propane, tri-methylol-ethane, penta-erythritol, glycerin etc. As for poly isocyanates compound, for example, hexa-methylene-di-isocyanate, di-phenyl-methane-di-isocyanate, tri-range-isocyanate, Iso-holo-di-isocyanate, additament of tri-range-isocyanate and tri-methylol-propane, additament of hexa-methylene-di-isocyanate and tri-methylol-ethane.

As for compound of ionomerization for polyurethane, sulfonic acid, polyol having an carboxylic acid etc, for example, di-methylol-propionic acid, di-methylol-propionic acid, di-methylol-butyric acid, ethylene glycol, et cetera.

Ionomerization ratio for polyurethane is preferably about 30 to 70%. The cross-linking density is low and solvent resistance is worse when this ionomerization is extremely small. The dispersion is worse when this ionomerization is extremely big.

Because acrylic resins may have poor barrier properties against plasticizers and solvents such as oils, the acrylic resin is preferably used together with a water-soluble resin. Examples of water-soluble resins include polyvinyl alcohols, modified polyvinyl alcohols, polyvinyl acetals, polyethylene-imine, polyvinyl pyrrolidone, polyacrylamide, starch and derivatives thereof, cellulose and derivatives thereof, gelatin, casein, et cetera.

Among such water-soluble resins, polyvinyl alcohols and modified polyvinyl alcohols are preferable because they exhibit superior binding effects with pigments and the recorded portions exhibit excellent durability against plasticizers and solvents such as oils. Particularly preferred are modified polyvinyl alcohols such as acetoacetyl-modified polyvinyl alcohol, carboxy-modified polyvinyl alcohol, diacetone-modified polyvinyl alcohol and the like.

Among such modified polyvinyl alcohols, typically, acetoacetyl-modified polyvinyl alcohol having a polymerization degree of about 500 to 1800, and preferably about 700 to 1800, and diacetone modified-polyvinyl alcohol having a polymerization degree of about 500 to 3000, and preferably about 700 to 3000, are preferably used.

The water-soluble resin may include acetoacetyl-modified polyvinyl alcohol with a polymerization degree of about 500 to 1800. When such a water-soluble resin, in particular, a polyvinyl alcohol or a modified polyvinyl alcohol is used, the proportion of water-soluble resin to total solids of the above-described acrylic resin is from about 10 to 45 mass %, preferably from about 15 to 40 mass %, and more preferably from about 20 to 40 mass %. Within the range of about 20 to 40 mass %, a good binder effect, good durability of recorded portions against solvents, and good Flexo ink adhesion is obtained.

Zinc stearate is preferably used in the protective layer as a lubricant, because the addition of a small amount of zinc stearate reduces sticking without lowering the barrier properties. Average particle size about 0.2 to 1.0 μm Zinc stearate, is preferably contained in a proportion of 5 to 25 mass % of total solids of the protective layer. Within this range, both the barrier properties and the ability to prevent sticking can further be improved. One of the ordinary skill in the art will recognize that other lubricant(s) may be used together with zinc stearate, so long as the desired effects are not lost.

The protective layer can be applied by any known coating technique such as, for example, air-knife coating, vari-bar blade coating, gravure coating, rod blade coating, short-dwell coating, curtain coating, die coating, et cetera.

In addition to the above, various auxiliaries may be added to the protective layer, such as lubricants, anti-foaming agents, wetting agents, preservatives, fluorescent brighteners, dispersing agents, thickeners, colorants, antistatic agents, cross-linking agents and the like.

Various known leuco dyes, developers, sensitizers, pigments, binders, various auxiliaries and the like can be used to form the heat-sensitive recording layer.

As for binder of the heat-sensitive recording material, core cell emulsion may be contained and the cell layer may be copolymer of styrene-(meta) acrylic which was used as emulsifiers of monomer for forming copolymerized core layer.

The composite method of such an emulsion is not exclusive, for example, the core cell emulsion obtains in which it aims because it copolymerizes the monomer, prepare the monomolecular pre-emulsion liquid, add the polymerization initiator, using styrene-(meta) acrylic which is polymeric emulsifiers. Still styrene-(meta) acrylic copolymer remains as it is without being copolymerized on the surface of the particle that is core cell emulsion, more specifically, on the cell layer. Then the core layer becomes core cell emulsion that monomer is polymerized plastic.

Specific examples of monomer components usable for preparing the acrylic resin include: (meta) methyl acrylate, (meta) ethyl acrylate, (meta) butyl acrylate, 2-ethylhexyl acrylate, 2-hydroxypropyl acrylate, 2-hydroxy butyl acrylate, 2-aminoethyle acrylate, 2-(N-methyl amino) ethyl acrylate, 2-(N,N-dimethyl amino) ethyl acrylate, diethylene glycol acrylate, vinyl esters such as vinyl acetate, vinyl propionate and the like; aromatic vinyl compounds such as styrene, vinyltoluene, vinylbenzene and the like, acrylamide compounds such as acrylamide, methacrylamide, N-methylolacrylamide, N-methylolmethacrylamide and the like, heterocyclic vinyl compounds such as vinyl pyrrolidone and the like, .alpha.-olefins such as ethylene, propylene and the like, dienes such as butadiene and the like. At least styrene, (meta) ester acrylate and styrene (meta) ester acryl include one or a combination of monomers selected from hydroxyl, methylol, glycigil and amino group are preferably and especially styrene (meta) ester acryl is more preferably.

The emulsion, which was made with above such as methods is called soap free emulsion and high water resistance, which does not use the emulsifier by surfactant. The core cell emulsion which is styrene (meta) ester acryl copolymer as emulsifier of monomer that polymerize and then make core layer is excellent water and anti blocking and anti chemical resistance.

When the core cell emulsion is used as a binder for the heat-sensitive recording layer, due to the parameter of energy, it may cause sticking and thermal head residues that are fused or softened by heat produced from the thermal head to happen. To prevent such issues, among such core layers of core cell emulsion, those having a glass transition temperature Tg of about 10 to 50° C. and more preferably about 20 to 40.° C., are preferred and the molecular weight is preferably from about $1\times10^5$ to $5\times10^5$ and more preferably from about $1.5\times10^5$ to $3.0\times10^5$. Moreover a glass transition temperature Tg of cell layers of styrene (meta) ester acryl copolymer which is emulsifying agent and cell layer is preferably from about 50 to 150° C. and more preferably about 60 to about 100° C., are preferred and the molecular weight is preferably from about 1000 to 50000 and more preferably from about 3000 to 15000.

To obtain high water and chemical resistance, the acid value is preferably from about 20 to 200 and more preferably from about 20 to 100. The acid value is measured by KOH titrimetric analysis.

The core cell emulsion is preferably from about 5 to 25 mass % and more preferably from about 7 to 25 mass % of total solids of the heat-sensitive recording layer. Within the range of about 5 to 25 mass %, the aforementioned desired effects such as excellent adhesion with the support layer, and water resistance, can be readily attained.

Examples of preferable leuco dyes include triphenylmethane-, fluoran-, phenothiazine-, auramine-, spiropyran-, and indolylphthalide-based leuco dyes. Such leuco dyes may be used alone or in combination. Specific examples of leuco dyes include 3-(4-diethylamino-2-ethoxyphenyl)-3-(1-ethyl-2-methylindol-3-yl)-4-azapht-halide, Crystal violet lactone, 3-(N-ethyl-N-isopentylamino)-6-methyl-7-anilinofluoran, 3-diethylamino-6-methyl-7-anilinofluoran, 3-diethylamino-6-methyl-7-(o, p-dimethylanilino)fluoran, 3-(N-ethyl-N-p-toluidino)-6-methyl-7-anilinofluoran, 3-(N-ethyl-p-toluidino)-6-methyl-7-(p-toluidino)fluoran, 3-pyrrolidino-6-methyl-7-anilinofluoran, 3-di(N-butyl)amino-6-methyl-7-anilinofluoran, 3-di(N-butyl)amino-7-(o-chloroanilino) fluoran, 3-di(N-pentyl)amino-6-methyl-7-anilinofluoran, 3-(N-cyclohexyl-N-methylamino)-6-methyl-7-anilinofluoran, 3-diethylamino-7-(o-chloroanilino)fluoran, 3-diethylamino-7-(m-trifluoromethylanilino)fluoran, 3-diethylamino-6-methyl-7-chlorofluoran, 3-diethylamino-6-methylfluoran, 3-cyclohexylamino-6-chlorofluoran, 3-(N-ethyl-N-hexylamino)-6-methyl-7-(p-chloroanilino)fluoran, et cetera.

Developers may be used alone or in combination. Specific examples of developers include 4-hydroxy-4'-isopropoxydiphenylsulfone, 4-hydroxy-4'-allyloxydiphenylsulfone, 4,4'-isopropylidenediphenol, 4,4'-cyclohexylidenediphenol, 2,2-bis(4-hydroxyphenyl)-4-methylpentane, 2,4'-dihydroxydiphenylsulfone, 4,4'-dihydroxydiphenylsulfone, 3,3-diallyl-4,4'-dihydroxydiphenylsulfone, 4-hydroxy-4'-methyldiphenylsulfone, 1,1-bis(4-hydroxyphenyl)-1-phenylethane, 1,4-bis[.alpha.-methyl-.alpha.-(4'-hydroxyphenyl)ethyl]benzene and like phenolic compounds; N-p-tolylsulfonyl-N'-phenylurea, 4,4'-bis[(4-methyl-3-phenoxycarbonylaminophenyl) ureido]diphenylmethane, N-p-tolylsulfonyl-N'-p-butoxyphenylurea and like compounds having sulfonyl group(s) and/or ureido group(s); zinc 4-[2-(p-methoxyphenoxy)ethyloxy]salicylate, zinc 4-[3-(p-tolylsulfonyl)propyloxy]salicylate, zinc 5-[p-(2-p-methoxyphenoxyethoxy)cumyl]salicylate and like aromatic carboxylic acid zinc salts; et cetera.

In one embodiment, to obtain the heat sensitive material with high clarity and sensitivity, the average particle size of leuco dye and developer are preferably from about 0.3 to 0.8 μm and more preferably from about 0.4 to 0.8 and most preferably from about 0.4 to 0.7 μm.

Examples of binders include polyvinyl alcohols of various molecular weights, modified polyvinyl alcohols, starch and derivatives thereof, methoxycellulose, carboxymethylcellulose, methylcellulose, ethylcellulose and like cellulose derivatives, sodium polyacrylate, polyvinyl pyrrolidone, acrylamide-acrylic ester copolymers, acrylamide-acrylic ester-methacrylic acid terpolymers, styrene-maleic anhydride copolymer alkali salts, polyacrylamides, sodium alginate, gelatin, casein and like water-soluble polymeric materials, polyvinyl acetates, polyurethanes, styrene-butadiene copolymers, polyacrylic acid, polyacrylic acid esters, vinyl chloride-vinyl acetate copolymers, polybutyl methacrylate, ethylene-vinyl acetate copolymers, styrene-butadiene-acrylic copolymers and like hydrophobic polymer latexes, et cetera.

The heat-sensitive recording layer may be applied by any known coating technique such as, for example, air-knife coating, vari-bar blade coating, gravure coating, rod blade coating, short-dwell coating, curtain coating, die coating, et cetera.

In applications of the image onto as an office label or address label, food price tag, industrial label, medical wrist band and auto odograph, high clarity heat-sensitive material is required, which are preferably from about 30 to 50% and more preferably from about 35 to 50% and most preferably from about 35 to 45% haze. A heat-sensitive recording material preferably includes Flexo press printability.

Various types of ultraviolet curing inks containing such components are commercially available. Examples of such inks include the THRMOKETT HR Series, FLEXOCURE Σ Series (manufactured by Flint Group), THERMAL 3 EXS Series (manufactured by Water, Ink Technology Inc), et cetera.

The heat-sensitive recording material according to the second embodiment can be prepared by known methods. For example, the above-described leuco dye and developer may be separately pulverized and dispersed together with an aqueous binder solution using a disperser such as a ball mill, and then mixed and stirred with a sensitizer, a pigment and a variety of auxiliaries, so as to prepare a heat-sensitive recording layer coating composition. A protective layer coating composition is also prepared by mixing the silica dispersion, acrylic resin, other binder(s) and a variety of auxiliaries, and stirring the mixture. The heat-sensitive recording layer coating composition and the protective layer coating composition are then applied and dried.

Embodiments of the present invention will be described below by way of examples, which are not intended to limit the invention. In the following Examples and Comparative Examples, "parts" and "%" represent "parts by mass" and "% by mass", respectively, unless otherwise specified.

Preparation of Leuco Dye Dispersion (Dispersion (a))

A composition comprising 10 parts of 3-di(N-butyl) amino-6-methyl-7-anilinofluoran, 5 parts of a 10% aqueous solution of poly vinyl alcohol, and 15 parts of water was pulverized using a sand mill to an average particle diameter of 0.5 micron, thus giving a leuco dye dispersion (Dispersion (a)).

Preparation of Leuco Developer Dispersion (Dispersion (b))

A composition comprising 10 parts of 3,3'-diallyl-4,4'-dihydroxydiphenylsulfone 5 parts of a 10% aqueous solution of poly vinyl alcohol, and 15 parts of water was pulverized using a sand mill to an average particle diameter of 0.6 micron, thus giving a leuco dye dispersion (Dispersion (b)).

Preparation of Heat-Sensitive Recording Layer Coating Composition

A composition comprising 20 parts of Dispersion (a), 35 parts of Dispersion (b), 7 parts of a 10% aqueous solution of poly vinyl alcohol, 19 parts of styrene butadiene copolymer, 15 parts of a 20% aqueous solution of core cell emulsion (Johncryl 537), and 4 parts of additives were mixed and stirred to give a heat-sensitive recording layer coating composition.

Preparation of Protective Layer Coating Composition

A composition comprising 34 parts of a 10% aqueous solution of acetoacetyl-modified polyvinyl alcohol (trade name: Gohsefimer Z-200, manufactured by Nippon Synthetic Chemical Industry Co., Ltd.; polymerization degree: 1000), 16 parts of a 20 nm particle of colloidal silica (trade name: Snowtex O, manufactured by Nissan Chemical Co., Ltd.), 16 parts of Zinc stearate (0.4 micron), 9 parts of a polyurethane ionomer (trade name: hydran AP-30F, manufactured by DIC), and 25 parts of silica (trade name: Aerodisp W7215, manufactured by EVONIC, average secondary particle diameter: 180 nm; primary particle diameter: 20 nm) and 1 part of additives was mixed and stirred to give a protective layer coating composition.

Preparation of Heat-Sensitive Recording Material

The heat-sensitive recording layer coating composition was then applied to the 76 micron clear polypropylene film (less 4% haze) in an amount of 3.6 g/m$^2$ on a dry weight basis and dried. The protective layer coating composition was further applied to the heat-sensitive recording layer in an amount of 2.0 g/m$^2$ on a dry weight and dried.

COMPARATIVE EXAMPLE I-2

A heat-sensitive recording material was prepared in the same manner as in Comparative Example I-1, except that 16 parts of a colloidal silica were reduced in Comparative Example I-1.

COMPARATIVE EXAMPLE I-3

A heat-sensitive recording material was prepared in the same manner as in Comparative Example I-1, except that 30 parts of a colloidal silica were used in Comparative Example I-1.

COMPARATIVE EXAMPLE I-4

A heat-sensitive recording material was prepared in the same manner as in Comparative Example I-1, except that 25 parts of a colloidal silica were removed in Comparative Example I-1.

COMPARATIVE EXAMPLE I-5

A heat-sensitive recording material was prepared in the same manner as in Comparative Example I-1, except that 16 parts of a colloidal silica were reduced in Comparative Example I-1.

COMPARATIVE EXAMPLE I-6

A heat-sensitive recording material was prepared in the same manner as in Comparative Example I-1, except that 25 parts of a silica (Trade name: Sylojet P612) which is average secondary particle diameter is 900 nm or more were used instead of 16 parts of silica used in Comparative Example I-1.

EXAMPLE I-1

A heat-sensitive recording material was prepared in the same manner as in Comparative Example I-1, except that 25 parts of a zinc stearate were added in Comparative Example I-1.

EXAMPLE I-2

A heat-sensitive recording material was prepared in the same manner as in Comparative Example I-1, except that 20 parts of a urethane ionomer were used in Comparative Example I-1.

EXAMPLE I-3

A heat-sensitive recording material was prepared in the same manner as in Comparative Example I-1, except that 9 parts of a urethane ionomer were removed in Comparative Example I-1.

EXAMPLE I-4

A heat-sensitive recording material was prepared in the same manner as in Comparative Example I-1, except that 16 parts of a zinc stearate were removed in Comparative Example I-1.

EXAMPLE I-5

A heat-sensitive recording material was prepared in the same manner as in Comparative Example I-1, except that 49 parts of a 10% aqueous solution of poly vinyl alcohol (Z-200) were used instead of 25 parts of silica used in Comparative Example I-1.

EXAMPLE I-6

A heat-sensitive recording material was prepared in the same manner as in Comparative Example I-1, except that 54 parts of a 10% aqueous solution of poly vinyl alcohol (Z-200) were used instead of 25 parts of silica used in Comparative Example I-1.

Ink Adhesion

Each heat-sensitive recording material was printed with a 0.5 cc UV Flexo ink (trade name: FLEXOCURE Σ series, manufactured by Flint Group) using an RI printer (manufactured by Akira Seisakusho Corporation), and the printed heat-sensitive recording material was irradiated with ultraviolet light using a UV irradiator.

A Magic tap (trade name: Scotch Magic Tape 810 ½" width) was applied for 60 seconds and peeled from the printed portion of the resulting heat-sensitive recording material, and the ink adhesion was rated as follows:

A: No peeling of the printed portion; excellent adhesion

B: Slight peeling of the printed portion; no practical problems

C: Peeling of the printed portion; lower adhesion.

Anti-Sticking Properties

The printed portion of the heat-sensitive recording material was subjected to color development at 0.25 inch/sec and 25% intensity using a thermal recording tester (trade name: 840 DL/G, manufactured by Printrex), and the crack, shrink and strain on the printed line were visually examined and rated as follows:

A: No crack, shrink and strain of the printed portion; excellent printing

B: Slight crack, shrink or strain of the printed portion; no practical problems

C: Shrink or strain of the printed portion and stop the feed; bad printing.

Haze Properties

The heat-sensitive recording material was measured the haze using a Haze meter (trade name: Haze-gard plus Illuminant CIE-C (THB-425), manufactured by BYK Gradner), and rated as follows:

A: Haze 30~40%: excellent clarity

B: Haze 41~45%: no practical problems

C: Haze 46~56%: high haze and translucent.

Barrier Properties

The heat-sensitive recording material was painted using a maker (tradename: EXPO Yellow, manufactured by SANFORD), the protective layer of heat-sensitive recording material and wait for a few minute, check the marked portion of the resulting heat-sensitive recording material and the barrier was rated as follows:

A: No change the yellow color and see black spots: excellent barrier

B: Slightly see black spots: no practical problems

C: Change the color from yellow to dark yellow and see lots of black spots: bad barrier.

Blistering

Each heat-sensitive recording material was printed with a 0.5 cc water base Flexo ink (trade name: FLEXOCURE Σ series, manufactured by Flint Group) using an hand roller and heat the printed strips for 30 min at 60° C.

The printed portion of the heat-sensitive recording material obtained after the ink adhesion evaluation was subjected to color development at 2ips, high energy using a thermal recording tester (trade name: Atlantek400, manufactured by) to see an image. The printed portion of the resulting heat-sensitive recording was visually examined and rated as follows:

A: No blistering of the printed portion; excellent printing

B: Slight blistering of the printed portion; no practical problems

C: Blistering of the printed portion.

Surface Strength

A Magic tap (trade name: Scotch Magic Tape 810 ½" width) was applied for 60 seconds and peeled from the heat-sensitive recording material, and the protective layer was rated as follows:

A: No peeling of the printed portion; excellent surface strength

B: Slight peeling of the printed portion; no practical problems

C: Peeling of the printed portion; lower surface strength

FIG. 4 is a tabular summary of the test results for the Comparative Examples I-1 to I-6 using the rating system set forth above. FIG. 5 is a tabular summary of the test results for the Examples I-1 to I-5 using the rating system set forth above.

Although the present invention has been illustrated and described with respect to several preferred embodiments thereof, various changes, omissions and additions to the form and detail thereof, may be made therein, without departing from the spirit and scope of the invention.

What is claimed is:

1. A heat-sensitive recording material, comprising:

a support;

a heat-sensitive recording layer comprising a leuco dye and a developer; and a protective layer comprising a pigment and a binder that comprises urethane ionomer, where the heat-sensitive recording layer is located between the protective layer and the support, where the pigment comprises secondary articles with an average particle diameter of 30 to 900 nm formed by aggregation of amorphous silica primary particles with a particle diameter of 3 to 70 nm, and the secondary particles are present in a proportion of about 5 to 35 mass % relative to total solids of the protective layer and the colloidal silica is present in a proportion of about 1 to 25 mass % relative to total solids of the protective layer.

2. The heat-sensitive recording material according to claim 1, wherein the support layer has a haze less than about 10%.

3. The heat-sensitive recording material of claim 1, further comprising an anti-slip layer on a surface of the support layer opposite from the heat-sensitive recording layer such that the support is located between the anti-slip layer and the heat-sensitive recording layer.

4. The heat-sensitive recording material of claim 1, where the binder of the protective layer comprises a water-soluble resin.

5. The heat-sensitive recording material of claim 4, where the binder further comprises acrylic resin; and the water-soluble resin comprises polyvinyl alcohol or a modified polyvinyl alcohol, the polyvinyl alcohol or modified polyvinyl alcohol being present in a proportion of about 10 to 45 mass % based on total solids of the acrylic resin.

6. The heat-sensitive recording material of claim 5, where the water-soluble resin comprises acetoacetyl-modified polyvinyl alcohol with a polymerization degree of about 500 to 1800.

7. The heat-sensitive recording material of claim 1, where the protective layer comprises zinc stearate having particles of an average particle diameter of about 0.2 to 1.0 μm and a proportion of about 5 to 25 mass % relative to total solids of the protective layer.

8. The heat-sensitive recording material of claim 1, where the heat-sensitive recording material includes core cell emulsion and the cell layer comprises a copolymer of styrene-(meta) acrylic used as emulsifiers of monomer for forming copolymerized core layer.

9. The heat-sensitive recording material of claim 8, where the core shell emulsion has a proportion of about 5 to 25 mass % relative to total solids of the heat-sensitive recording layer.

10. The heat-sensitive recording material of claim 1, where the leuco dye comprises 3-di(N-butyl)amino-6-methyl-7-anilinofluoran.

11. The heat-sensitive recording material of claim 1, where an average particle diameter of the leuco dye and the developer are about 0.3 to 0.8 μm.

12. The heat-sensitive recording material of claim 1, where the haze amount is about 30 to 50%.

13. A heat-sensitive recording material, comprising:

a support;

a heat-sensitive recording layer comprising a leuco dye and a developer; and a protective layer comprising a pigment and a binder, where urethane ionomer is present in the protective layer in a proportion of about 1 to 25 mass % relative to total solids of the protective layer, where the heat-sensitive recording layer is located between the protective layer and the support, and where the pigment comprises secondary particles with an average particle diameter of 30 to 900 nm formed by aggregation of amorphous silica primary particles with a particle diameter of 3 to 70 nm, and the secondary particles are present in a proportion of about 5 to 35 mass % relative to total solids of the protective layer and the colloidal silica is present in a proportion of about 1 to 25 mass % relative to total solids of the protective layer.

14. The heat-sensitive recording material according to claim 13, wherein the support layer has a haze less than about 10%.

15. The heat-sensitive recording material of claim 13, further comprising an anti-slip layer on a surface of the support layer opposite from the heat-sensitive recording layer such that the support is located between the anti-slip layer and the heat-sensitive recording layer.

16. The heat-sensitive recording material of claim 13, where the binder of the protective layer comprises a water-soluble resin.

17. The heat-sensitive recording material of claim 16, where the binder further comprises acrylic resin; and the water-soluble resin comprises polyvinyl alcohol or a modified polyvinyl alcohol, the polyvinyl alcohol or modified polyvinyl alcohol being present in a proportion of about 10 to 45 mass % based on total solids of the acrylic resin.

18. The heat-sensitive recording material of claim 17, where the water-soluble resin comprises acetoacetyl-modified polyvinyl alcohol with a polymerization degree of about 500 to 1800.

19. The heat-sensitive recording material of claim 13, where the protective layer comprises zinc stearate having particles of an average particle diameter of about 0.2 to 1.0 μm and a proportion of about 5 to 25 mass % relative to total solids of the protective layer.

20. The heat-sensitive recording material of claim 13, where the heat-sensitive recording material includes core cell emulsion and the cell layer comprises a copolymer of styrene-(meta) acrylic used as emulsifiers of monomer for forming copolymerized core layer.

21. The heat-sensitive recording material of claim 20, where the core shell emulsion has a proportion of about 5 to 25 mass % relative to total solids of the heat-sensitive recording layer.

22. The heat-sensitive recording material of claim 13, where the leuco dye comprises 3-di(N-butyl)amino-6-methyl-7-anilinofluoran.

23. The heat-sensitive recording material of claim 13, where an average particle diameter of the leuco dye and the developer are about 0.3 to 0.8 μm.

24. The heat-sensitive recording material of claim 13, where the haze amount is about 30 to 50%.

* * * * *

UNITED STATES PATENT AND TRADEMARK OFFICE

CERTIFICATE OF CORRECTION

PATENT NO. : 8,415,270 B2
APPLICATION NO. : 12/694802
DATED : April 9, 2013
INVENTOR(S) : Yada et al.

It is certified that error appears in the above-identified patent and that said Letters Patent is hereby corrected as shown below:

In the Claims:
Column 12
Line 18, please delete “articles” and insert -- particles --

Signed and Sealed this
Second Day of July, 2013

Teresa Stanek Rea
*Acting Director of the United States Patent and Trademark Office*